US010066375B2

(12) United States Patent
Kostorz

(10) Patent No.: US 10,066,375 B2
(45) Date of Patent: Sep. 4, 2018

(54) SANITARY FITTING FOR AT LEAST TWO FLUIDS

(71) Applicant: Grohe AG, Hemer (DE)

(72) Inventor: Ole Benedikt Kostorz, Menden (DE)

(73) Assignee: Grohe AG, Hemer (DE)

( * ) Notice: Subject to any disclaimer, the term of this patent is extended or adjusted under 35 U.S.C. 154(b) by 120 days.

(21) Appl. No.: 15/135,988

(22) Filed: Apr. 22, 2016

(65) Prior Publication Data

US 2016/0312449 A1 Oct. 27, 2016

(30) Foreign Application Priority Data

Apr. 22, 2015 (DE) ..... 10 2015 005 098

(51) Int. Cl.
*E03C 1/04* (2006.01)

(52) U.S. Cl.
CPC ..... *E03C 1/0404* (2013.01); *E03C 1/0403* (2013.01); *E03C 2001/0415* (2013.01); *E03C 2201/40* (2013.01); *Y10T 137/9464* (2015.04)

(58) Field of Classification Search
None
See application file for complete search history.

(56) References Cited

U.S. PATENT DOCUMENTS 5,205,313 A * 4/1993 Moretti ..... F16K 35/14 137/112
5,293,901 A * 3/1994 Guzzini ..... E03C 1/04 137/595
8,322,377 B2 * 12/2012 Di Nunzio ..... F16K 11/078 137/625.41
9,492,348 B2 * 11/2016 Novak ..... A61H 35/02
9,551,136 B2 * 1/2017 Keiter ..... E03C 1/0404
9,644,353 B1 * 5/2017 Chang ..... E03C 1/0404
2005/0189023 A1 * 9/2005 Hsien ..... E03C 1/0404 137/801
2006/0266424 A1 * 11/2006 Filtness ..... E03C 1/0403 137/625.4
2007/0235091 A1 10/2007 Granot
2008/0178935 A1 * 7/2008 Thomas ..... E03C 1/023 137/1
2011/0030823 A1 * 2/2011 Seal ..... E03C 1/04 137/603
2012/0168000 A1 * 7/2012 Gioira ..... E03C 1/0404 137/334
2012/0312401 A1 * 12/2012 Gioira ..... F16L 41/023 137/603
2014/0326352 A1 * 11/2014 Kury ..... F16L 33/2071 138/109

* cited by examiner

*Primary Examiner* — Craig Schneider
*Assistant Examiner* — Frederick D Soski
(74) *Attorney, Agent, or Firm* — Muncy, Geissler, Olds & Lowe, P.C.

(57) ABSTRACT

A sanitary fitting having a housing with a spout, wherein a first fluid can be carried through a first hose to an outlet of the spout and a second fluid can be carried through a second hose to the outlet of the spout, and wherein the first hose is located in the second hose.

10 Claims, 2 Drawing Sheets

SANITARY FITTING FOR AT LEAST TWO FLUIDS

This nonprovisional application claims priority under 35 U.S.C. § 119(a) to German Patent Application No. 10 2015 005 098.2, which was filed in Germany on Apr. 22, 2015, and which is herein incorporated by reference.

BACKGROUND OF THE INVENTION

Field of the Invention

The present invention relates to a sanitary fitting for demand-based provision of at least two fluids. Sanitary fittings of this nature frequently are used in conjunction with washbasins, sinks, and/or bathtubs in sanitary facilities.

Description of the Background Art

Known sanitary fittings are used in particular for demand-based drawing of mixed water with a desired mixed water temperature. For this purpose, a sanitary fitting can have a mixing valve or a thermostat cartridge for mixing cold water at a cold water temperature and hot water at a hot water temperature into mixed water at the mixed water temperature. Such mixing valves or thermostat cartridges can in particular be actuated through a lever and/or other actuators of a housing of the sanitary fitting. When drawn, the mixed water is carried through the housing by a hose to an outlet of a spout of the sanitary fitting.

Also known from the conventional art are sanitary fittings in which at least one additional fluid can also be carried to the outlet of the spout simultaneously with the mixed water. This second fluid can be, for example, water that has been subjected to a treatment, for example filtering and/or carbonation. In these sanitary fittings, the additional fluid being drawn is delivered to the outlet of the spout through a separate second hose, so that at least two separate hoses are required for the two fluids. However, especially in sanitary fittings in which the spout can be pulled out of the housing of the sanitary fitting, this has proven to be disadvantageous because the two hoses can jam or impede one another when the spout is being pulled out of the housing or during installation of the hoses in the spout.

SUMMARY OF THE INVENTION

It is therefore an object of the invention to at least partially solve the problems described with reference to the prior art, and in particular to provide a sanitary fitting with which at least two fluids can be delivered separately to an outlet of a spout without a plurality of separate hoses.

The sanitary fitting according to an exemplary embodiment of the invention can have a housing with a spout, wherein a first fluid can be carried through a first hose to an outlet of the spout and a second fluid can be carried through a second hose to the outlet of the spout, and wherein the first hose is located at least partially in the second hose.

The proposed sanitary fitting can be used, for example, in conjunction with sinks, washbasins, and/or bathtubs in sanitary facilities. Such sanitary facilities are useful in particular for human hygiene and health. A first fluid and a second fluid, in particular, can be drawn in a demand-based manner by means of the sanitary fitting. For this purpose, the sanitary fitting has a housing with a spout, wherein the spout is in particular arranged such that it can rotate on the housing or can be pulled out of the housing. The housing and/or the spout are made at least partially of metal, as for example brass, and/or of plastic. Moreover, the housing can be attached to a support, for example the sink, the washbasin, and/or the bathtub. To this end, the support can have an opening into which the housing can be at least partially inserted. The first fluid is in particular water or mixed water that can be mixed by the sanitary fitting from cold water at a cold water temperature and hot water at a hot water temperature into mixed water at a desired mixed water temperature. For this purpose, the sanitary fitting can have a mixing valve or a thermostat cartridge that can be actuated by a user through a lever and/or another actuator of the housing. The first fluid can be carried through a first hose to an outlet of the spout. The outlet can be, for example, a flow regulator through which the first fluid exits the sanitary fitting. The second fluid is, in particular, water that has been subjected to a treatment. The treatment can include filtering and/or carbonation of the water, for example. The first fluid and the second fluid are carried separately from one another in the sanitary fitting so that mixing of the first fluid and the second fluid in the sanitary fitting is largely prevented. To this end, the second fluid can be carried through a second hose to the outlet of the spout. The first hose and/or the second hose is, in particular, a plastic hose that can be designed to be flexible. Moreover, the first hose is at least partially located in the second hose. This means, in other words, that the first hose runs at least partially through the second hose. In this way, two separate hoses do not run through the spout, making it easier to pull the spout out of the housing and to assemble the sanitary fitting.

In addition, the first hose and the second hose are arranged can be at least partially concentric with one another.

Furthermore, the second fluid can be carried in an annular space between the first hose and the second hose to the outlet of the spout. The annular space can be substantially annular in design and can extend at least partially along the first hose and/or second hose.

Moreover, the first hose can lead from a first nipple, and the second hose leads from a second nipple, to the outlet of the spout. The first nipple and/or the second nipple is an at least partially tubular component onto which the first hose and/or the second hose can be placed in a fluid-carrying manner.

The first nipple can be inserted at least partially into the second nipple. In particular, the first nipple is capable of being inserted into the second nipple in such a manner that the second nipple protects the first hose that has been placed on the first nipple from detaching from the first nipple. To this end, the second nipple presses the first hose onto the first nipple, in particular with forces directed radially inward. Thus, the second nipple serves as protection from detachment of the first hose.

The first nipple and the second nipple can be inserted at least partially into a connection. The connection can be an at least partially cylindrical component that can be rigidly attached to the housing. However, the connection can also be guided and/or free-hanging and/or placed at a distance from the sanitary fitting. Preferably, the connection is arranged to be movable in space so that it can follow a spatial displacement of the first hose and second hose, e.g., when rotated and/or displaced relative to the sanitary fitting. Preferably, the connection is made at least partially of plastic. Moreover, the first fluid and/or the second fluid can be delivered to the first hose and/or the second hose in particular through the connection.

In addition, the first nipple can be sealed by a first seal and the second nipple can be sealed by a second seal with respect to the connection. The first seal and/or the second seal is in particular an O-ring.

Furthermore, the connection can have a first bore for the first nipple and a second bore for the second nipple. In particular, the first nipple can be inserted into the first bore and/or the second nipple can be inserted into the second bore. To this end, the first bore has a first inside diameter, in particular, that essentially corresponds to a first outside diameter of the first nipple. Accordingly, the second bore has a second inside diameter, in particular, that essentially corresponds to a second outside diameter of the second nipple. The first nipple can be inserted at least partially into the first bore, in particular, and/or the second nipple can be inserted at least partially into the second bore, in particular, of the connection in a fluid-tight manner.

Moreover, at least one first fluid passage can terminate in the first bore and at least one second fluid passage terminates in the second bore. The first fluid can be delivered to the first hose through the first fluid passage and/or the second fluid can be delivered to the second hose through the second fluid passage.

The second hose can be attached to the second nipple by a sleeve. The sleeve is in particular a crimp sleeve that is plastically deformable for attachment.

According to an embodiment of the sanitary fitting, sections of the first hose and of the second hose can be arranged in a loop. A "loop" can be formed, for example, by a flexibly movable part of the first hose and second hose. This loop is in particular located in a section of the first hose and second hose between the spout and the first nipple or the second nipple. A flow regulator seated in the spout at the outlet can be pulled out of the spout, by which means the first hose and the second hose are pulled out of the spout. This reduces the size of the loop and/or moves it. Moreover, the flow regulator is movable and can be used to freely move the stream from the sanitary fitting. The connection and in particular the first nipple and the second nipple are then preferably located below the sanitary fitting, for example hanging loosely beneath a washstand. The first hose and the second hose are then located in a loop below the housing of the sanitary fitting.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
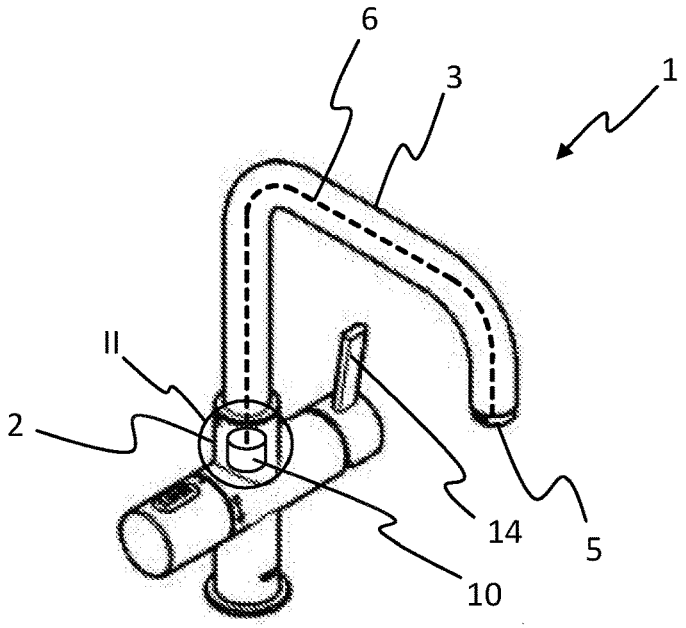
FIG. 1 illustrates a sanitary fitting in a perspective representation.

FIG. 1 shows a sanitary fitting 1 with a housing 2 and a spout 3 in a perspective representation. The spout 3 is rotatably arranged on the housing 2 and can be pulled out of the housing 2. The housing 2 also has a lever 14, by means of which a valve that is not shown here can be actuated. Additionally attached in the housing 2 is a connection 10 from which a second hose 6, shown schematically here, leads through the spout 3 to an outlet 5 of the spout 3.

Figure 2:
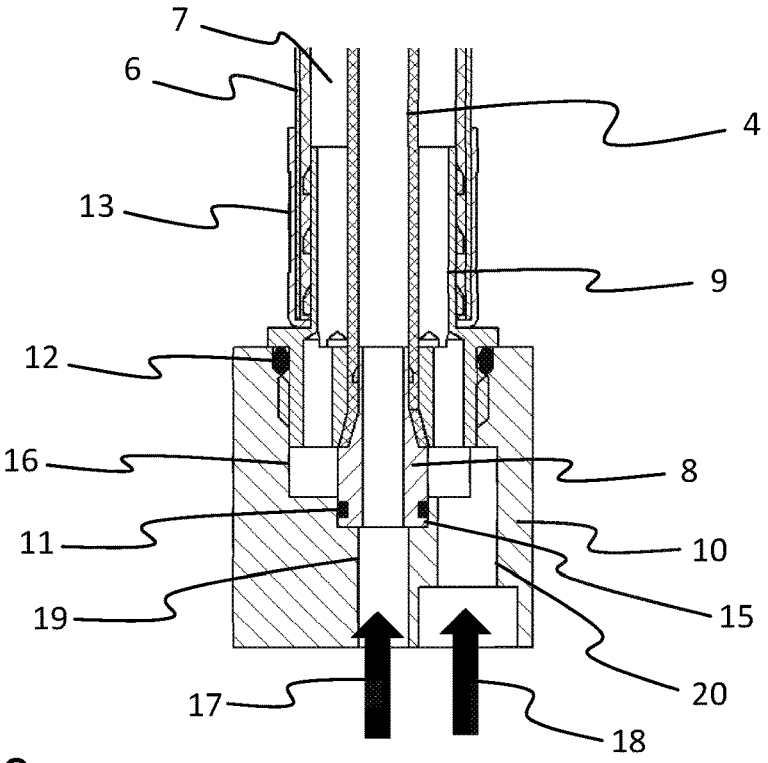
FIG. 2 illustrates a cross-sectional view through a connection of the sanitary fitting

FIG. 2 shows a cross-sectional representation of the region of the sanitary fitting 1 that is labeled II in FIG. 1. Particularly evident here is a first hose 4, which is arranged concentrically in the second hose 6. In this way an annular space 7 is formed by the first hose 4 and the second hose 6. The first hose 4 is placed on a first nipple 8 and the second hose 6 is placed on a second nipple 9. The second hose 6 is protected from detaching from the second nipple 9 by means of a sleeve 13, which is a crimp sleeve here. The connection 10 has a first bore 15 into which the first nipple 8 can be inserted, and a second bore 16 into which the second nipple 9 can be inserted. The first nipple 8 can be sealed in the first bore 15 by means of a first seal 11, and the second nipple 9 can be sealed in the second bore 16 with a second seal 12, with respect to the connection 10. The first seal 11 and the second seal 12 are each O-rings here. A first fluid passage 19 for a first fluid 17 terminates in the first bore 15 and a second fluid passage 20 for a second fluid 18 terminates in the second bore 16. Consequently the fluids can be delivered separately from one another to the outlet 5 of the spout 3 shown in FIG. 1, the first fluid 17 being delivered through the first hose 4, and the second fluid 18 being delivered through the annular space 7 between the first hose 4 and the second hose 6.

Figure 3:
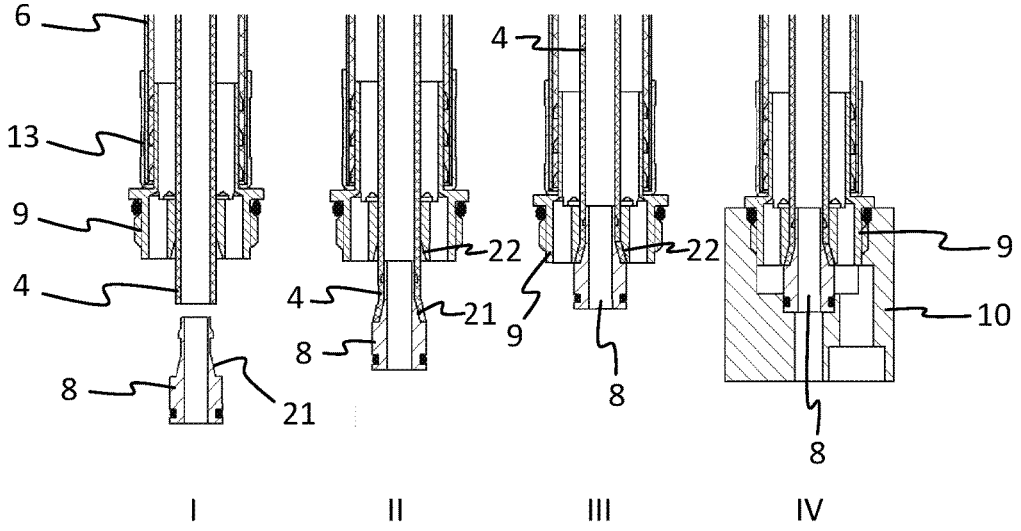
FIG. 3 illustrates an assembly process of a first nipple and second nipple on the connection.

FIG. 3 shows an assembly process of the first nipple 8 and of the second nipple 9 on the connection 10. In step I, the second hose 6 is already attached to the second nipple 9 by the sleeve 13. The first hose 4 extends through the second hose 6 and the second nipple 9 and has not yet been placed on the first nipple 8. Placement of the first hose 4 on the first nipple 8 takes place in step II. In this step, the end of the first hose 4 is spread apart by an outer cone 21 of the first nipple 8. In step III, the first nipple 8 is inserted into the second nipple 9. By this means the first hose 4 on the first nipple 8 is protected by the second nipple 9 from detaching. To this end, the second nipple 9 has an inner cone 22 corresponding to the outer cone 21. The first hose 4 and the second hose 6 can thus be attached to the connection 10 in step IV using only three components, namely the first nipple 8, the second nipple 9, and the sleeve 13.

Figure 4:
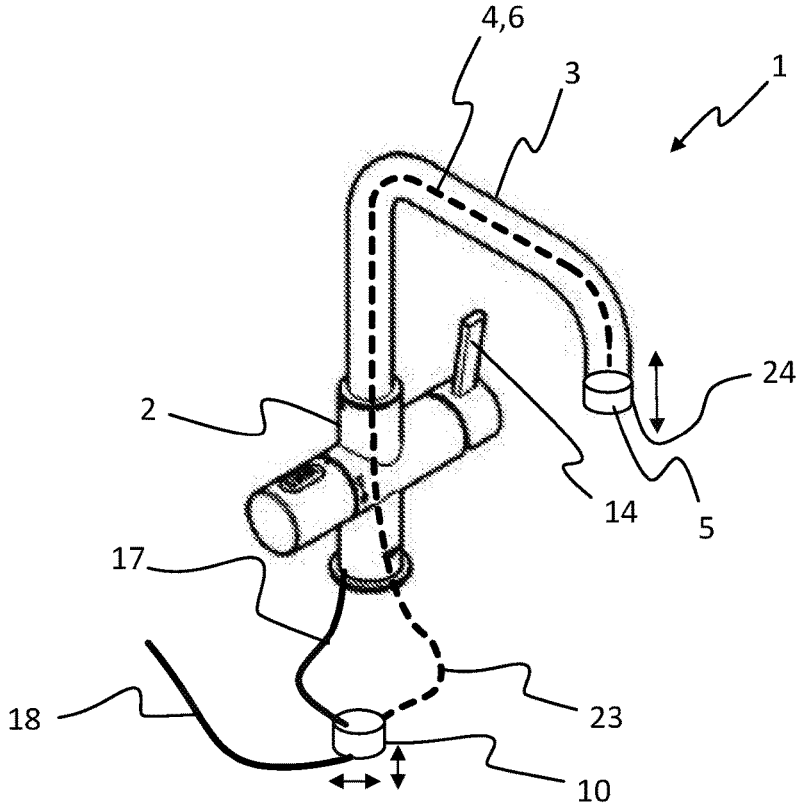
FIG. 4 illustrates a variant of the sanitary fitting from FIG. 1.

FIG. 4 shows a ("pull-out") variant of the sanitary fitting 1 from FIG. 1 in which the first hose 4 and the second hose 6 lie together in a loop 23 below the sanitary fitting 1 or below the housing 2. Thus, the first fluid 17 (e.g., the mixed water produced by the sanitary fitting) is carried by a first line, and the second fluid 18 (e.g., from a separate preparation unit) is carried by a second line, to the connection 10. The connection 10 hangs (e.g., without separate guidance and/or retention to the housing 2 or to the washstand that is not shown) at the end of the concentric double-hose arrangement (4, 6). A flow regulator 24 at the outlet 5 of the spout 3 of the sanitary fitting 1 is movable and can be pulled out of the spout 3. In this process, the double-hose arrangement can be moved together with the connection 10 so that the shape or form of the loop 23 changes.

The present invention is particularly characterized in that it allows two fluids to be carried separately from one another to an outlet of a spout without a plurality of separate hoses.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A sanitary fitting comprising:

a housing with a spout;

a first hose adapted to have a first fluid carried there through to an outlet of the spout; and a second hose adapted to have a second fluid carried there through to the outlet of the spout, wherein the first hose is located at least partially in the second hose, wherein the first hose leads from a first nipple and the second hose leads from a second nipple to the outlet of the spout, wherein the first nipple is insertable at least partially into the second nipple, and wherein a portion of the second nipple directly contacts an exterior surface of the first hose, such that the portion of the second nipple presses the first hose onto the first nipple in a radially inward direction.

2. The sanitary fitting according to claim 1, wherein the first hose and the second hose are arranged to be at least partially concentric with one another.

3. The sanitary fitting according to claim 1, wherein the second fluid is carried in an annular space between the first hose and the second hose to the outlet of the spout.

4. The sanitary fitting according to claim 1, wherein the second hose is attacheable to the second nipple by a sleeve.

5. The sanitary fitting according to claim 1, wherein sections of the first hose and of the second hose are arranged in a loop.

6. The sanitary fitting according to claim 1, wherein the portion of the second nipple that directly contacts the exterior surface of the first hose has a tapered section that corresponds to a tapered section of the first nipple, such that the first hose is pressed between the tapered section of the second nipple and the tapered section of the first nipple.

7. The sanitary fitting according to claim 1, wherein the first nipple and the second nipple are insertable at least partially into a connection.

8. The sanitary fitting according to claim 7, wherein the first nipple is sealable by a first seal and the second nipple is sealable by a second seal with respect to the connection.

9. The sanitary fitting according to claim 7, wherein the connection has a first bore for the first nipple and a second bore for the second nipple.

10. The sanitary fitting according to claim 9, wherein at least one first fluid passage terminates in the first bore and at least one second fluid passage terminates in the second bore.

* * * * *